United States Patent [19]

Rayborn

[11] 4,216,836

[45] Aug. 12, 1980

[54] PROCESS AND SYSTEM FOR RECOVERING SOLID PARTICULATE ADDITIVES FROM A DRILLING FLUID

[76] Inventor: Jerry J. Rayborn, 3633 Inwood Ave., New Orleans, La. 70114

[21] Appl. No.: 873,085

[22] Filed: Jan. 27, 1978

[51] Int. Cl.[2] ..... E21B 21/00

[52] U.S. Cl. ..... 175/66; 209/173

[58] Field of Search ..... 175/65, 66, 72; 209/173

[56] References Cited

U.S. PATENT DOCUMENTS

| | | | |
|---|---|---|---|
| 2,530,676 | 11/1950 | Berg et al. | 175/66 X |
| 2,576,283 | 11/1951 | Chaney | 175/66 |
| 2,756,965 | 7/1956 | Howe | 175/66 |
| 2,828,860 | 4/1958 | Morris | 209/173 |
| 3,221,825 | 12/1965 | Henderson | 175/72 |
| 4,063,603 | 12/1977 | Rayborn | 252/8.5 C |

OTHER PUBLICATIONS

"Drilling Fluids File", p. 68, World Oil Jan. 1975.

*Primary Examiner*—William F. Pate, III

[57] ABSTRACT

A process and system is provided permitting the recovery of solid particulate material, particularly solid copolymer beads, from a drilling fluid which also contains drilled solids of the same and larger size as the particulate material. The drilling fluid returns are passed to a separator, such as a shale shaker, which screens from the fluid a major proportion of the drilled solids along with the particulate material. The latter fraction is then passed into a vessel containing a weighted liquid having a specific gravity less than that of the drilled solids but greater than that of the particulate material. In such vessel, the particulate material is allowed to rise to the surface of the liquid while the drilled solids settle therein. The particulate material can then be skimmed from the upper portion of the vessel and returned to the well for recirculation therein. To conserve the weighted liquid, the particulate material removed from the vessel can be passed through a separator to separate it from any weighted liquid so that the latter can be returned to the vessel. Similarly, the drilled solids removed from the vessel can likewise be separated from any weighted liquid removed with them and the liquid returned to the vessel.

8 Claims, 1 Drawing Figure

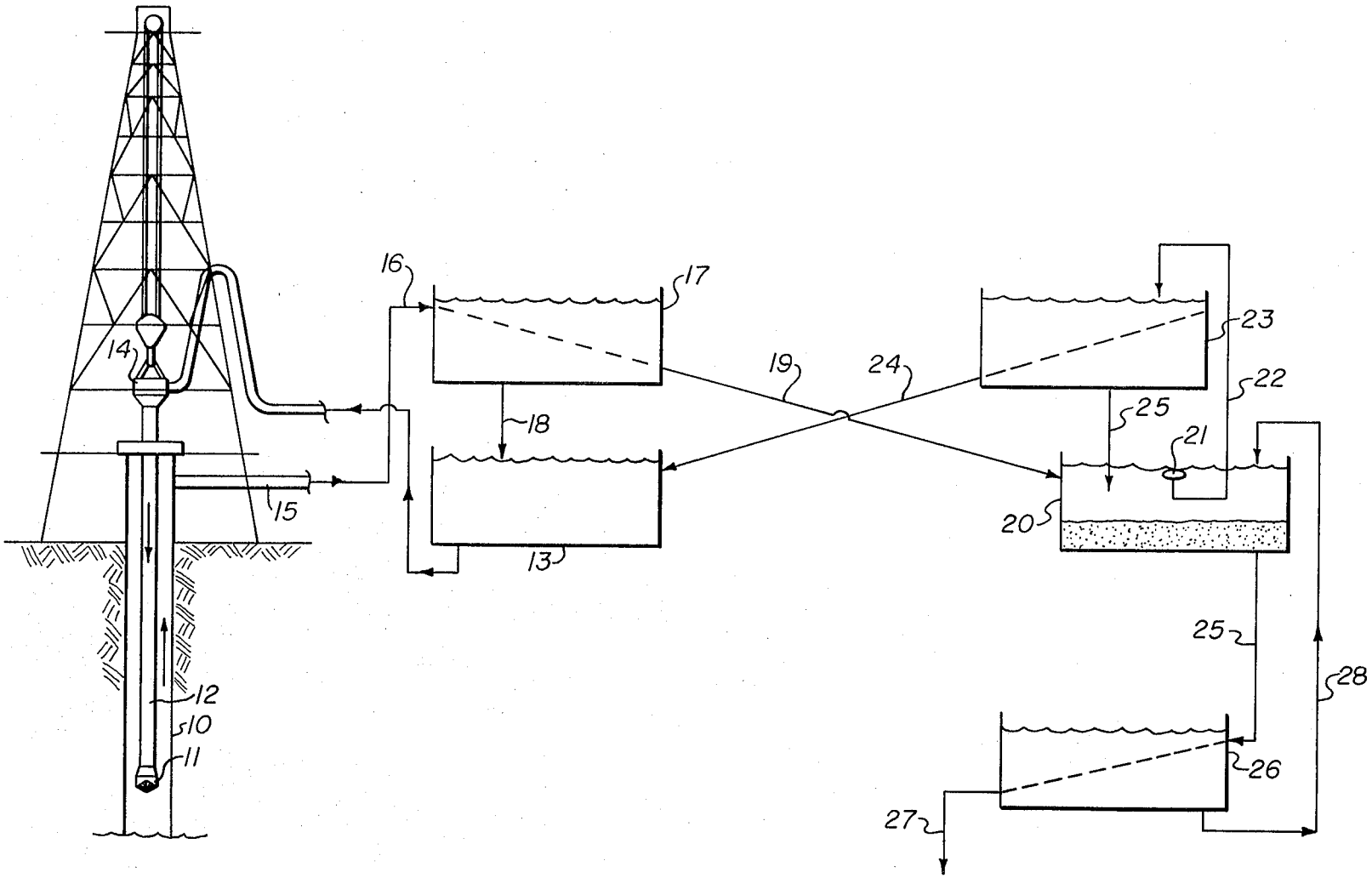
28
23
22
26
25
21
25
20
27
24
19
17
18
13
16
15
12
10
11
14

PROCESS AND SYSTEM FOR RECOVERING SOLID PARTICULATE ADDITIVES FROM A DRILLING FLUID

This invention relates to a process and system for the recovery of relatively low gravity particulate material, such as copolymer beads, from a drilling fluid so that such material can be recirculated through the well with the drilling fluid.

During the drilling of a well, it is common practice to pass the drilling mud returns containing drilled solids through a shale shaker or the like to remove as many of the solids from the mud as is possible. This is desirable because recirculated drilled solids tend to be ground into finer and finer sizes, thereby building up the solids content of the mud. As the solids content increases, the mud must be thinned by adding additional water, which necessitates the addition of more weighting material to maintain the mud at its desired weight. For these and other reasons, it is desirable in many cases for the returned mud to be of a low drilled solids content. In order to provide such a mud, it is conventional to screen the mud in a shale shaker having screens ranging in size from 10 to 200 mesh with the average mesh size being from about 20 to 80 mesh. Heretofore, any solid additive, such as lubricating copolymer beads and lost circulation materials, having a particle size larger than that of the shale shaker screen, would be removed from the system with the drilled solids. As a result and as a practical matter, such particulate material is circulated once through the system and is then discarded. If it is desired to maintain the particulate material in the system for several circulations, additional material has to be added to compensate for that removed by the shale shaker. This can be relatively expensive.

It is, therefore, an object of this invention to provide an apparatus and process which will permit recirculation of particulate material, especially copolymer beads, in a well, while at the same time removing drilled solids, at least a part of which has a particle size approximating that of the particulate material, thereby permitting the maintenance of a low solids system.

Another object is to provide such an apparatus and system for the recovery of an added particulate material from a drilling mud, even though such mud contains drilled solids having a particle size of the order of that of the particulate material.

In accordance with this invention, the drilling mud containing an added particulate material having a specific gravity substantially less than that of the drilled solids is separated into a first fraction consisting essentially of the drilling mud and a second fraction comprising the particulate material and the drilled cuttings. The latter fraction is then passed into a separating zone or apparatus containing a flotation liquid having a specific gravity less than that of the cuttings but greater than that of the particulate material. In this apparatus, the particulate material is permitted to float toward the surface of the liquid, while the drilled solids, being heavier than the liquid, settle toward the bottom. The particulate material is then skimmed from the surface of the liquid and thereafter separated from any flotation liquid removed with the particulate material. The thus recovered flotation liquid is then returned to the separation apparatus for further use. Similarly, the drilled solids can be removed from the lower portion of the separating apparatus along with some of the liquid and then separated from the latter so that the liquid can be returned to the separating apparatus.

Referring now to the drawing wherein there is shown schematically the apparatus of this invention capable of being used in performing the process, there is illustrated a well 10 which is being drilled by a bit 11 connected to the lower end of a drill string 12. As is conventional, drilling mud is pumped from a mud pit 13 through a swivel 14 into the drill string where it passes downwardly and out of the bit to return through the annulus to return line 15.

A particularly useful application of the apparatus and process of this invention is in connection with the use of copolymer beads in drilling muds to reduce friction as disclosed in my U.S. Pat. No. 4,063,603, to which reference is made and which is incorporated herein for all purposes. The copolymer beads can have a specific gravity within the range of 0.5 to 2.0 and preferably from 1.1 to 1.5 and are of a size within the range of 10 to 100 mesh (Tyler standard screen size), preferably 40 to 60 mesh. It will be seen that when such beads are used, and when an operator is attempting to maintain a low solids drilling mud by using, for example, an 80 mesh shaker screen, the beads will be removed from the system along with the drilled solids. In order to recover these beads and permit their use again, the drilling mud containing the drilled solids is passed via line 16 to a conventional shale shaker 17 which can be equipped with a screen having a finer mesh size than that of the beads. As a result, the drilling mud passes through the screen and is returned via line 18 to the mud pit 13.

The removed drilled solids and beads are passed via a line 19 to a separating tank or vessel 20 containing a flotation liquid having a specific gravity less than that of the drilled cuttings but greater than the beads. As a result, the beads are permitted to float to the surface of the liquid in the vessel from which they are removed by a suitable skimming apparatus 21, along with some of the liquid, and pass via a line 22 to the separator 23. In the latter, the beads are screened from the liquid and can be returned via a line 24 to the mud pit 13 for recirculation in the well. The recovered liquid can pass via a line 25 back to the vessel 20.

Similarly, the clay solids which settle in the bottom of the vessel 20 can be removed, along with some of the liquid in the vessel, via a line 25 and passed to another separator 26. In the latter, the clay solids are separated from the liquid and are discharged via a line 27, while the liquid is returned via line 28 to the vessel 20.

The flotation liquid can be of any desired type, provided that it has the requisite gravity lying between that of the particulate material and the drilled solids. Exemplary of such liquids are aqueous solutions of sodium carbonate, sodium chloride, potassium chloride, calcium chloride, zinc chloride with calcium chloride, calcium bromide, sodium nitrate, etc. The amount of these salts which are dissolved in water to form the liquid can be varied to control the specific gravity of the solution within certain ranges easily recognizable by a skilled chemist. It is preferred, especially when recovering copolymer beads, to use sodium carbonate because of its economy and inertness. The flotation liquid can be prepared by adding 110 pounds, for example, of the sodium carbonate to 42 gallons of water to yield a liquid having a density of about 1.15.

In addition to the recovery of copolymer beads, the apparatus and process of this invention can be used to recover other materials such as conventional lost circulation materials. Among these are nut hulls, cane fibers, cotton seed hulls, cedar fibers, sawdust and wood chips, rice hulls, cellophane flakes and shredded leather. Also, lost circulation materials comprising natural or synthetic resins in the form of flakes, fibers or particles, can include phenoseal, polystyrene, polyethylene, nylon, asphalt, Gilsonite and ground rubber.

As indicated, the shale shaker 17 is a conventional piece of equipment found on nearly every drilling rig. Shale shaker 26 and separator 23 will usually be provided as extra pieces of equipment and these can be conventional vibrating shakers, hydrocyclones, centrifuges or other devices capable of making a separation between the low density particulate material and the relatively high density liquid.

From the foregoing it will be seen that this invention is one well adapted to attain all of the ends and objects hereinabove set forth, together with other advantages which are obvious and which are inherent to the method.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawing is to be interpreted as illustrative and not in a limiting sense.

The invention having been described, what is claimed is:

1. In a process for drilling a well wherein a drilling fluid containing solid plastic beads having a screen size within the range of 10 to 100 mesh and specific gravity within the range of 0.5 to 2.0, the steps of: (a) separating the drilling fluid flowing from the well into a first fraction consisting essentially of said drilling fluid and a second fraction comprising said beads and cutting from the well, (b) passing the second fraction into a separating zone containing a liquid having a specific gravity less than the cuttings but greater than the beads and allowing the beads to rise toward upper portion of the liquid while allowing the cuttings to settle therein, and (c) recovering the beads from said separating zone and passing them, along with said first fraction, back to the well to be recirculated therein.

2. The process of claim 1 wherein the step of recovering the beads includes the step of removing the liquid containing same from the upper portion of said separating zone and separating the beads from the removed liquid and returning the thus separated liquid to the separating zone.

3. The process of claim 2, including the step of removing the cuttings and some of the liquid in said separating zone, separating the cuttings from the removed liquid and returning the latter to the separating zone.

4. The method of claim 1, wherein the spheres have a screen size within the range of 20 to 80 mesh.

5. The process of claim 1, wherein the weighted liquid is a solution of sodium carbonate.

6. In a process for drilling a well wherein a drilling mud weighted with barite and containing solid copolymer beads is circulated through the well and wherein the return mud is passed through a screen to separate it into a first fraction consisting essentially of the weighted drilling mud and a second fraction comprising the beads and cuttings, the steps of recovering the beads for recirculation in the well without at the same time recirculating cuttings having a size equal to or larger than that of the beads, comprising (a) passing the second fraction into a separating zone containing a weighted liquid having a specific gravity less than the cuttings but greater than the beads, (b) allowing the beads to rise and concentrate toward the upper portion of the liquid while allowing the cuttings to settle therein, and (c) recovering the beads from said separating zone and passing them along with the first fraction back to the well to be recirculated therein.

7. The process of claim 6, wherein the beads and some of the liquid from the separating zone are passed through a screen to separate the beads from the liquid and passing the latter back to separating zone.

8. The process of claim 7, wherein the liquid is weighted with calcium carbonate.

* * * * *